US005571218A

United States Patent [19]

Caniglia

[11] Patent Number: 5,571,218

[45] Date of Patent: Nov. 5, 1996

[54] NECKTIE RESTRAINING SHIRT

[76] Inventor: Bob Caniglia, 62 River Rd., Scarborough, N.Y. 10510

[21] Appl. No.: 570,722

[22] Filed: Dec. 11, 1995

[51] Int. Cl.[6] ..... A41B 1/08; A41D 27/00

[52] U.S. Cl. ..... 2/115; 2/145

[58] Field of Search ..... 2/113, 114, 115, 2/145, 144, 146, 148, 149, 150, 151, 152.1, 153, 154, 155, 156, 157, 105, 106

[56] References Cited

U.S. PATENT DOCUMENTS

| | | | |
|---|---|---|---|
| 2,011,325 | 8/1935 | Rowan | 2/115 |
| 2,030,905 | 2/1936 | Wolfe | 2/115 |
| 2,043,799 | 6/1936 | Jokela et al. | 2/115 |
| 2,074,535 | 3/1937 | Brokering | 2/115 |
| 2,223,176 | 11/1940 | Jakob | 2/115 |
| 2,541,660 | 2/1951 | Naftali | 2/115 |
| 2,551,863 | 5/1951 | Young | 2/115 |
| 2,624,050 | 1/1953 | Boller | 2/115 |
| 4,809,626 | 3/1989 | Tyner | 2/115 |

*Primary Examiner*—Jeanette E. Chapman

[57] ABSTRACT

A necktie restraining shirt is designed to selectively restrain or conceal the rear tail portion of a necktie. In a first embodiment, the shirt is provided with a small opening into which the rear tail portion of a necktie can be inserted. In a second embodiment, the shirt is provided with a loop of material through which the rear tail portion of the necktie can be positioned with the front portion of the necktie then overlying the tail portion so as to conceal it. In a third embodiment, the shirt is provided with both an opening to receive the rear tail portion of the necktie and a loop of material for receiving the front visible portion of the necktie. In this latter embodiment, the tail portion is concealed inside the shirt while the loop of material functions in the manner of a tie pin so as to prevent the front portion of the necktie from flopping around.

1 Claim, 4 Drawing Sheets

NECKTIE RESTRAINING SHIRT

BACKGROUND OF THE INVENTION

1. Field of the Invention

The present invention relates to clothing and more particularly pertains a new and improved shirt which is designed to concealingly retain the rear portion of a necktie.

2. Description of the Prior Art

The use of necktie restraining means on shirts is well known in the prior art. This is evidenced by the granting of a number of patents relating to various functional and structural aspects of necktie restraining devices. For example, U.S. Pat. No. 5,235,730, which issued to Townsend on Aug. 17, 1993, discloses a conventional and typical concealed necktie holding device. In this respect, the device consists of a small clamp which is attachable to the tail portion of a necktie, and a small chain leads from the clamp to a cross member which is positionable through a shirt button hole. In effect, this device prevents the tail portion of a necktie from becoming unattractively visible. As can be appreciated, this device is manufactured and sold separately from the shirt and tie.

Another example of a tie restraining device is to found in U.S. Pat. 5,216,785 which issued to Graef on Jun. 8, 1993. The tie fastener shown in this patent consists of three strips of flexible material joined together at one end. Each strip is identical to the others, with an inner strip being buttoned to a shirt and an outer strip being fed through the loop label of the tie. An intermediate strip is interposed between the inner and outer strips and serves to cover a shirt button and prevent the loop label of the tie from catching on the button. This fastener is designed to hold the complete tie assembly in juxtaposition to a shirt with the tail of the tie being retained by the loop label positioned behind the front visible portion of the tie. While being operable for its intended purpose, this device is also manufactured and sold separately from the shirt and its associated tie.

While each of these prior art patents disclose devices which fulfill their respective particular objectives and requirements, and are most likely quite functional for their intended purposes, it will be noticed that none of these patents disclose a necktie restraining means which is integrally or otherwise fixedly secured to a shirt in a permanent manner, whereby there is no requirement to purchase and then subsequently locate, when needed, a device for concealingly retaining the tail portion of a necktie in an attractive manner. As such, there apparently still exists a need for improvements in necktie restraining devices to the extent that a shirt itself could operate to hold a tie in a desired position without the use of separate independent hardware and in this respect, the present invention substantially fulfills this need.

SUMMARY OF THE INVENTION

In view of the foregoing disadvantages inherent in the known types of necktie restraining means now present in the prior art, the present invention provides a new necktie restraining means wherein the same can be utilized to eliminate the need for independent and separate tie restraining hardware which is normally designed to be attached between a tie and a shirt. As such, the general purpose of the present invention, which will be described subsequently in greater detail, is to provide a necktie restraining shirt and method which has many of the advantages of the necktie restraining means mentioned heretofore and many additional novel features that result in a necktie restraining means which is not anticipated, rendered obvious, suggested, or even implied by any of the prior art necktie restraining means, either alone or in any combination thereof.

To attain this, the present invention generally comprises a necktie restraining shirt which is designed to selectively restrain or conceal the rear tail portion of a necktie. In a first embodiment, the shirt is provided with a small opening into which the rear tail portion of a necktie can be inserted. In a second embodiment, the shirt is provided with a loop of material through which the rear tail portion of the necktie can be positioned with the front portion of the necktie then overlying the tail portion so as to conceal it. In a third embodiment, the shirt is provided with both an opening to receive the rear tail portion of the necktie and a loop of material for receiving the front visible portion of the necktie. In this latter embodiment, the tail portion is concealed inside the shirt while the loop of material functions in the manner of a tie pin so as to prevent the front portion of the necktie from flopping around.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new necktie restraining means and method which has many of the advantages of the necktie restraining means mentioned heretofore and many novel features that result in a necktie restraining means which is not anticipated, rendered obvious, suggested, or even implied by any of the prior art necktie restraining means, either alone or in any combination thereof.

It is another object of the present invention to provide a new necktie restraining means which may be easily and efficiently manufactured and marketed.

It is a further object of the present invention to provide a new necktie restraining means which is of a durable and reliable construction.

An even further object of the present invention is to provide a new necktie restraining means which is susceptible of a low cost of manufacture with regard to both materials and labor, and which accordingly is then susceptible of low prices of sale to the consuming public, thereby making such necktie restraining means economically available to the buying public.

Still yet another object of the present invention is to provide a new necktie restraining means which provides in the apparatuses and methods of the prior art some of the advantages thereof, while simultaneously overcoming some of the disadvantages normally associated therewith.

Still another object of the present invention is to provide a new and improved necktie restraining means which facilitates the use of a shirt itself to concealingly restrain the tail portion of a necktie without the use of independent tie restraining hardware.

Yet another object of the present invention is to provide a new and improved necktie restraining means which is designed to concealingly restrain the tail portion of a necktie while at the same time function as a tie pin to hold the front visible portion of a necktie in an attractive position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF PREFERRED EMBODIMENTS

Figure 1:
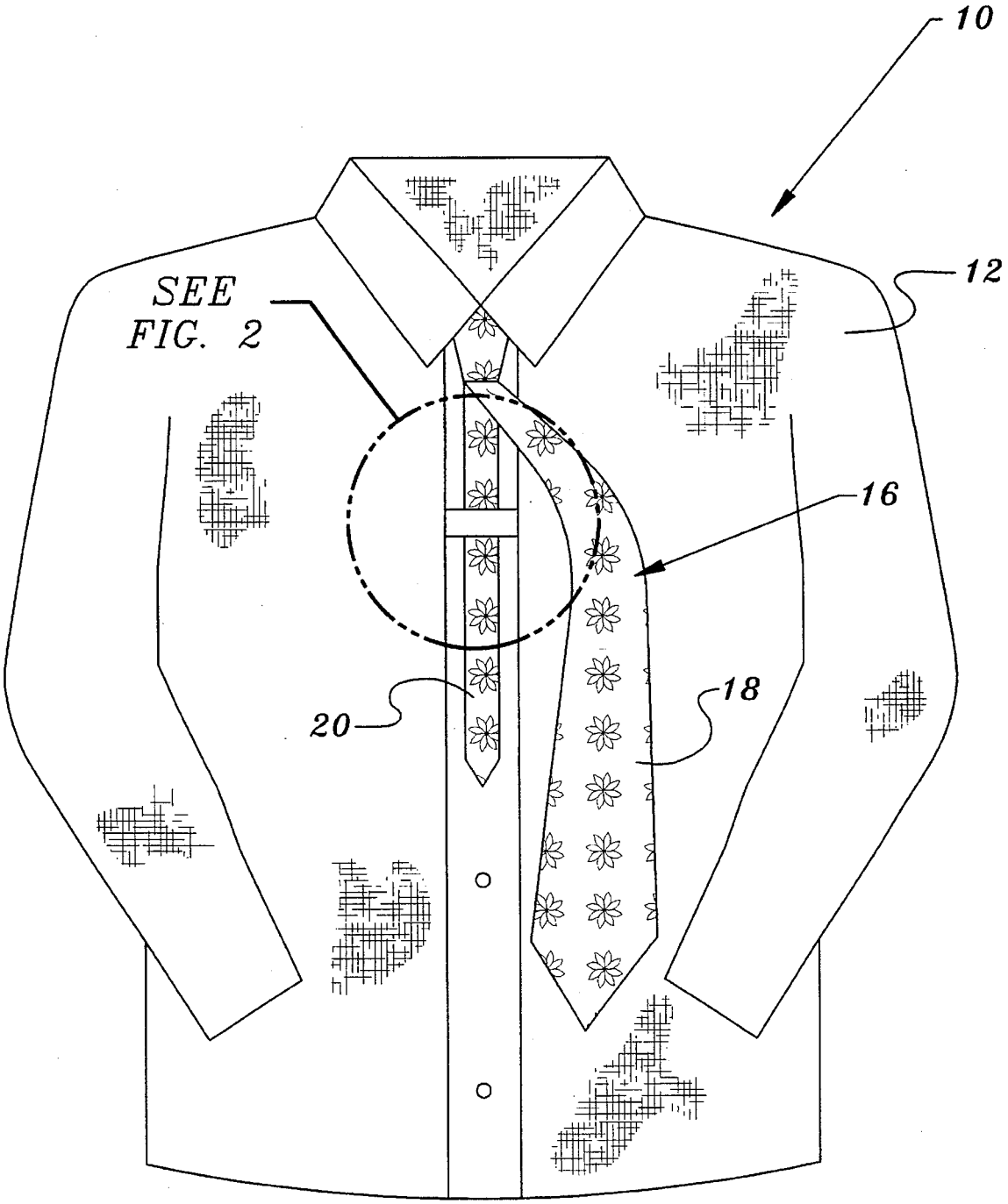
FIG. 1 is a front elevation view of a first embodiment of a necktie restraining shirt comprising the present invention.
Figure 2:
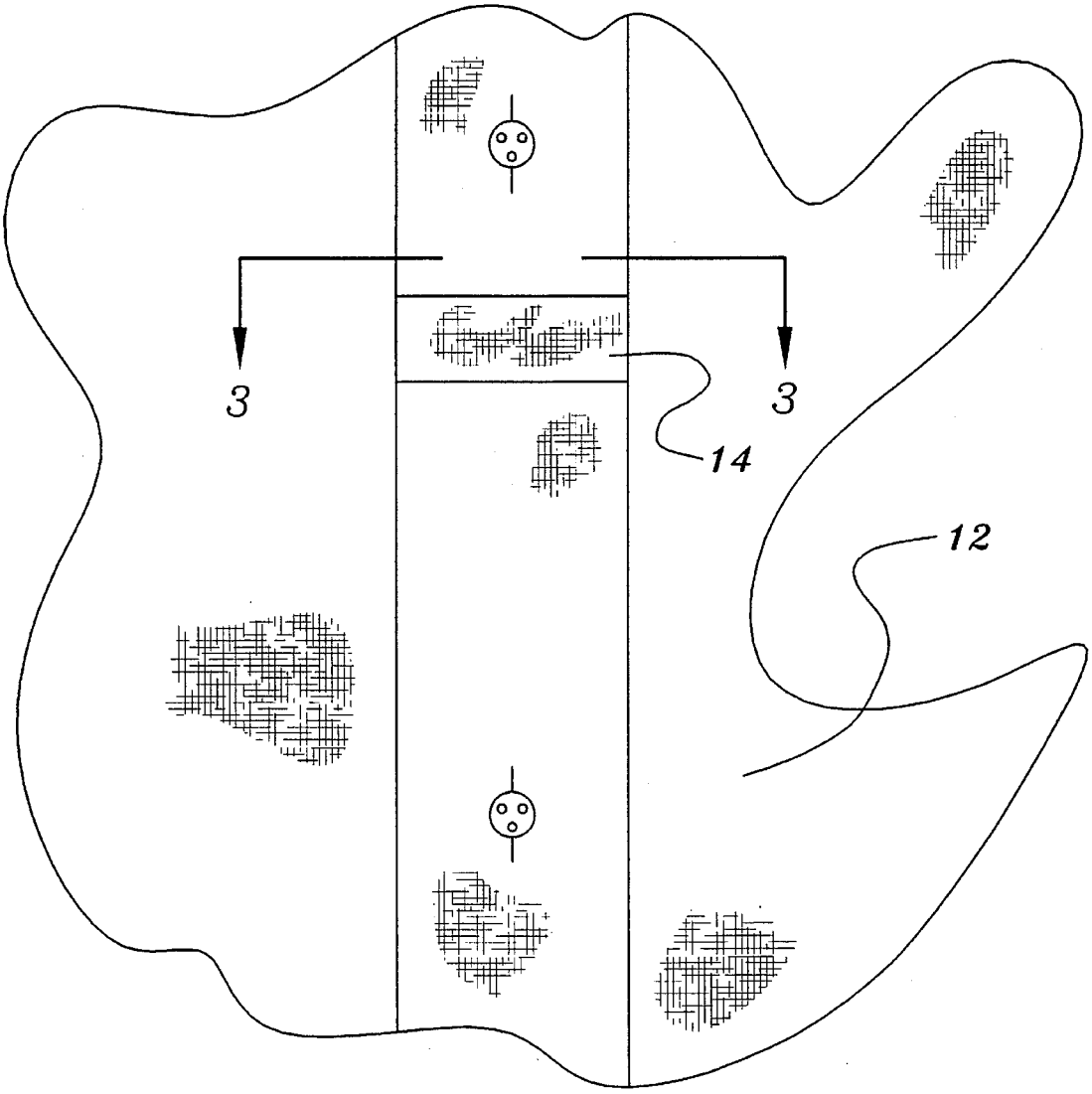
FIG. 2 is a detail view of the invention taken from FIG. 1 of the drawings.
Figure 3:
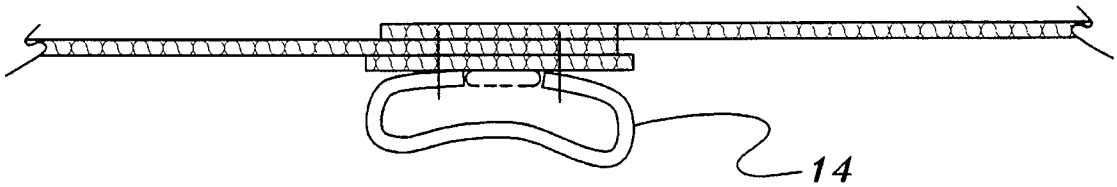
FIG. 3 is a cross-sectional view of the invention as viewed along the line 3—3 of FIG. 2.

With reference now to the drawings, and in particular to FIGS. 1, 2 and 3 thereof, a first embodiment of a new necktie restraining shirt embodying the principles and concepts of the present invention and generally designated by the reference numeral 10 will be described.

More specifically, it will be noted that the necktie restraining shirt 10 consists of a conventional shirt 12 of the type having a button closing front for the purpose of removing and putting the shirt on. In this first embodiment 10 of the invention, the shirt 12 is improved through the inclusion of a loop 14 of material which is sewn to a visible front portion of the shirt. While in the preferred embodiment 10, the loop 14 is sewn to shirt 12, it is to be understood that any convention means of attaching the loop to the shirt could be employed, to include the use of hoop and loop fasteners, adhesives, pins, staples, and the like, and all such fastening means are within the intent and purview of the present invention.

With particular reference to FIG. 1, it can be seen that a conventional necktie 16 typically includes a front decorative portion 18 and a rear tail portion 20 which is less decorative and which is ideally concealed by the front decorative portion during normal wear. To prevent the rear tail portion 20 of the necktie 16 from becoming unattractively visible while being worn with the shirt 12, the rear tail portion may be slipped through the loop 14 as clearly illustrated. This prevents the tail portion 20 from becoming displaced from behind the front portion 18 of the necktie 16 and thus, the shirt 12 itself operates to concealingly retain the necktie tail portion 20 in a desired position.

Figure 4:
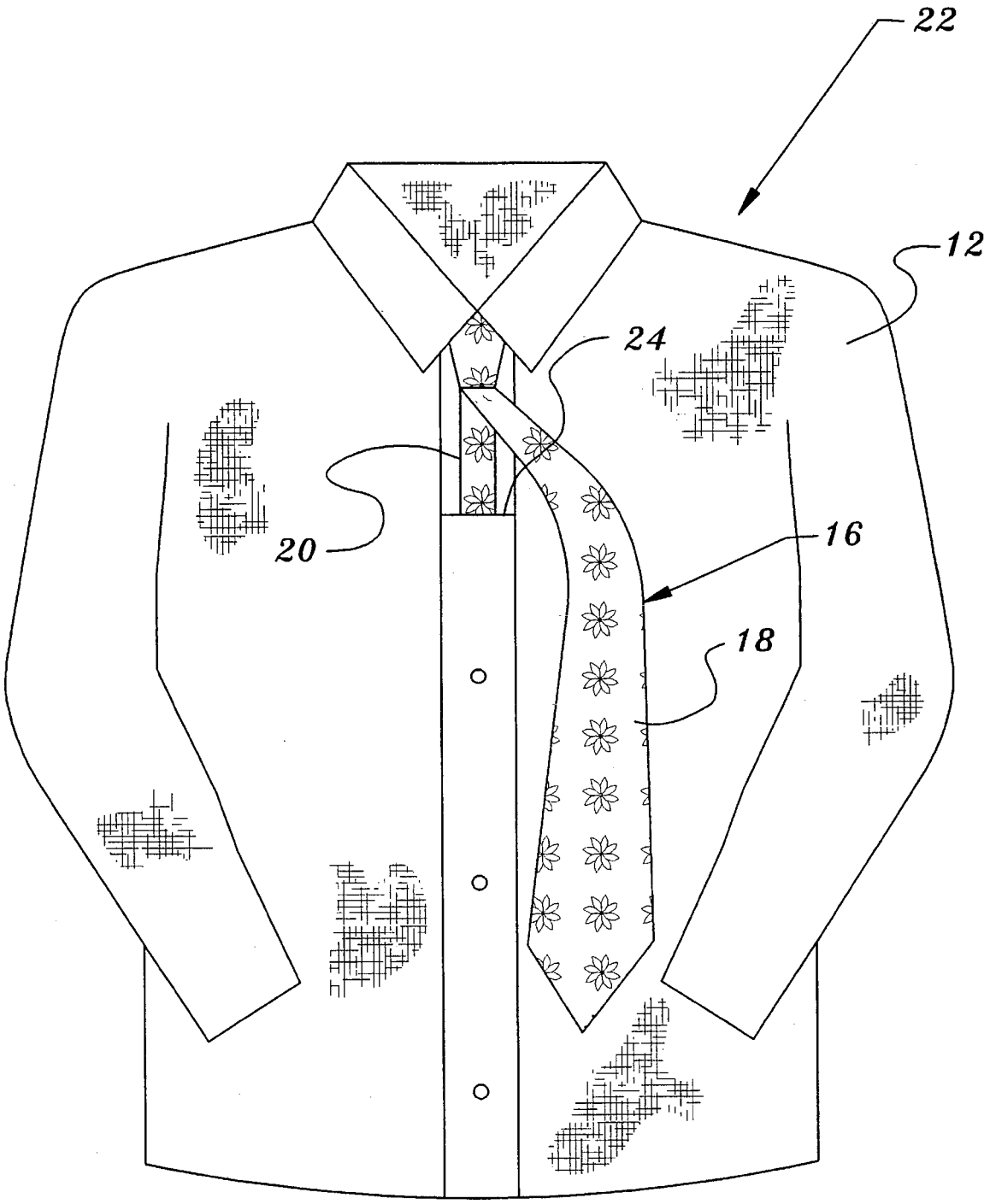
FIG. 4 is a front elevation view of a second embodiment of the invention.

FIG. 4 of the drawings illustrates a second embodiment 22 of the invention wherein the same comprises a conventional shirt 12 having a slit 24 positioned on a front portion thereof. The slit 24 comprises a through opening into which the tail portion 20 of a necktie 16 can be inserted. In this embodiment 22, the tail portion 20 is actually positioned behind a front visible portion of the shirt 12 and is permanently retained in this location by its positioning within the slit 24. The front visible portion 18 of the necktie 16 then operates to conceal the remaining visible portion of the necktie tail 20, as well as the opening 24. In this embodiment 22 then also, it can be seen that the shirt 12 operates to concealingly retain the necktie tail portion 20 is a desired location. As such, in both of the embodiments 10 and 22 of necktie restraining shirt 12, there is absolutely no need for separate independent hardware to be purchased and utilized for the purpose of attaching the rear tail portion 20 of a necktie 16 to a shirt.

Figure 5:
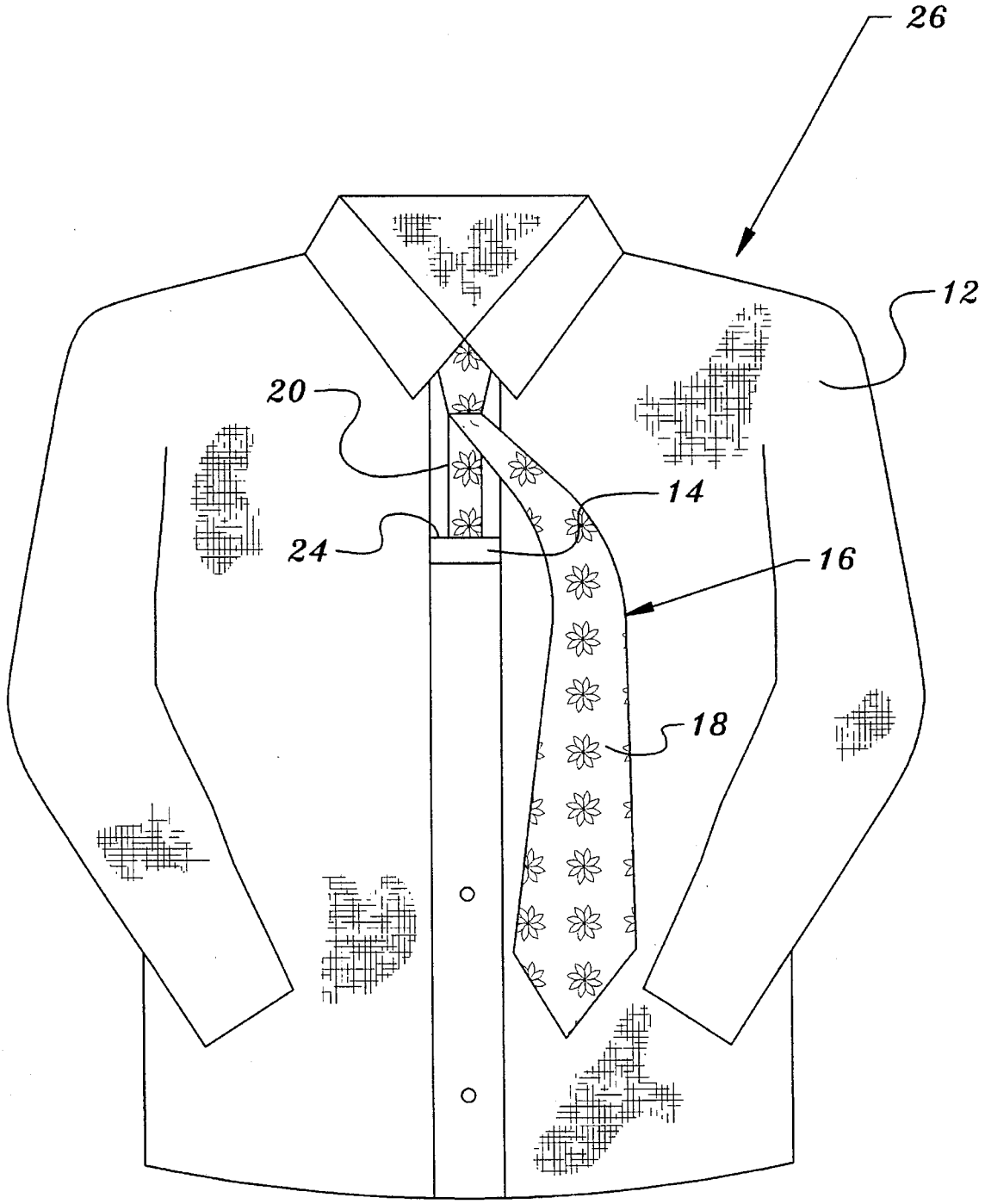
FIG. 5 is a front elevation view of a third embodiment of the invention.

FIG. 5 of the drawings discloses a final embodiment 26 of the invention wherein both a through opening 24 and necktie retaining loop 14 are utilized. In this embodiment 26, the slit 24 is positioned proximate the fixedly secured loop 14 on the shirt 12. This embodiment 26 allows the rear portion 20 of the necktie 16 to be positioned through the slit 24, so as to be concealingly retained behind the shirt 12, with the front visible portion 18 of the necktie 16 then being positionable through the loop 14, thereby eliminating the need for a tie pin. In this regard, the loop 14 could be decorated so as to improve its overall aesthetic appearance inasmuch as it is functioning in place of a tie pin. This latter embodiment 26 of shirt 12 absolutely eliminates any need for devices to concealingly restrain the rear portion 20 of a necktie 16 or for other devices which function in the manner of tie pins.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A necktie restraining means comprising:

a fabric shirt; and necktie retention means forming a part of and being attached to a front portion of said shirt, said necktie retention means serving to retain a rear tail portion of said necktie in an aligned engagement with said fabric shirt, whereby said rear tail portion is normally and more securely concealed from view behind a front visible portion of said fabric necktie;

wherein said necktie retention means includes a substantially horizontal opening in said shirt, said rear tail portion of said fabric necktie being positionable through and being retained by said opening; and wherein said necktie retention means further includes a loop of material fixedly secured to said front portion of said shirt, said front visible portion of said fabric necktie being positionable through and being retained by said loop.

* * * * *